US010012023B2

(12) United States Patent
Jensen et al.

(10) Patent No.: US 10,012,023 B2
(45) **Date of Patent: *Jul. 3, 2018**

(54) ROTATABLE WIRELINE TOOL OF ENHANCED HYDRAULIC DRIVE CONSISTENCY

(71) Applicant: Schlumberger Technology Corporation, Sugar Land, TX (US)

(72) Inventors: Michael Jensen, Richmond, TX (US); Ruben Martinez, Houston, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 314 days.

This patent is subject to a terminal disclaimer.

(21) Appl. No.: 14/830,180

(22) Filed: Aug. 19, 2015

(65) Prior Publication Data

US 2015/0354305 A1 Dec. 10, 2015

Related U.S. Application Data

(63) Continuation of application No. 13/316,239, filed on Dec. 9, 2011, now Pat. No. 9,127,507.

(60) Provisional application No. 61/422,881, filed on Dec. 14, 2010.

(51) Int. Cl.

| | |
|---|---|
| ***E21B 4/02*** | (2006.01) |
| ***E21B 3/00*** | (2006.01) |
| ***E21B 4/00*** | (2006.01) |
| ***E21B 4/18*** | (2006.01) |
| ***E21B 23/14*** | (2006.01) |
| ***E21B 29/00*** | (2006.01) |

(52) U.S. Cl.

CPC ..... *E21B 4/02* (2013.01); *E21B 3/00* (2013.01); *E21B 4/00* (2013.01); *E21B 4/006* (2013.01); *E21B 4/18* (2013.01); *E21B 23/14* (2013.01); *E21B 29/00* (2013.01); *E21B 29/002* (2013.01)

(58) Field of Classification Search

CPC ..... E21B 23/14; E21B 29/00; E21B 29/002; E21B 4/006; E21B 4/18

USPC ..... 166/104, 298, 297, 55, 55.8, 55.1, 55.7

See application file for complete search history.

(56) References Cited

U.S. PATENT DOCUMENTS

| | | | |
|---|---|---|---|
| 6,659,200 | B1 | 12/2003 | Eppink |
| 7,316,303 | B2 | 1/2008 | Smith |
| 2003/0024710 | A1 | 2/2003 | Post et al. |
| 2007/0251687 | A1 | 11/2007 | Martinez et al. |

(Continued)

FOREIGN PATENT DOCUMENTS

| | | | |
|---|---|---|---|
| GB | 2398308 | A | 8/2004 |
| WO | 03/005142 | A1 | 1/2003 |
| WO | 2009014932 | A2 | 1/2009 |

OTHER PUBLICATIONS

Extended European Search Report issued in European Patent Application No. 11250926.0 dated Dec. 9, 2015; 8 pages.

*Primary Examiner* — Caroline N Butcher

(74) *Attorney, Agent, or Firm* — Sara K. M. Hinkley

(57) ABSTRACT

A rotatable downhole cutting tool configured for enhanced drive consistency in low power circumstances. The tool is equipped with a hydraulic axial drive actuator suitable for use in wireline deployment. The actuator itself includes a reciprocating piston with a ball screw that threadably interfaces a ball nut for dampening the axial drive imparted by the piston. As such, even though hydraulically driven at generally well under about 10 horsepower, bounce in the axial drive is substantially eliminated.

13 Claims, 5 Drawing Sheets

(56) References Cited

U.S. PATENT DOCUMENTS

| | | | |
|---|---|---|---|
| 2008/0264689 | A1 | 10/2008 | Blount et al. |
| 2009/0018510 | A1 | 1/2009 | Madin et al. |
| 2012/0145394 | A1 | 6/2012 | Jensen et al. |

ROTATABLE WIRELINE TOOL OF ENHANCED HYDRAULIC DRIVE CONSISTENCY

CROSS-REFERENCE TO RELATED APPLICATIONS

This application is a continuation of co-pending U.S. patent application Ser. No. 13/316,239, filed Dec. 9, 2011, which claims benefit of, and claims priority to, U.S. Provisional Patent Application Ser. No. 61/422,881 filed Dec. 14, 2010, the entire disclosure of which is incorporated herein by reference.

FIELD

Embodiments described relate to delivery and use of rotatable devices such as drill-out and milling tools in a well. Such tools may be configured for downhole conveyance and delivery over a smaller and less expensive wireline platform without compromise to downhole force drive consistency.

BACKGROUND

Exploring, drilling and completing hydrocarbon wells are generally complicated, time consuming and ultimately very expensive endeavors. As a result, over the years increased attention has been paid to monitoring and maintaining the health of such wells. Premiums are placed on maximizing the total hydrocarbon recovery, recovery rate, and extending the overall life of the well as much as possible. Thus, logging applications for monitoring of well conditions play a significant role in the life of the well. Similarly, importance is placed on well intervention applications, such as clean-out techniques which may be utilized to modify downhole architecture and/or remove debris from the well so as to ensure unobstructed hydrocarbon recovery.

Following initial completions, the need to mill or drill-out downhole obstructions through interventional applications may arise. For example, it is not uncommon for regions of the well to naturally experience the buildup of scale and other debris which has a tendency to obstruct recovery and/or impede other downhole functionality such as the opening and closing of valves, sliding sleeves, etc. Furthermore, in many cases, a downhole obstruction may be present in the form of an irreversibly set flapper or isolation valve or other such architectural barrier. While such features may be intentionally locked in place, their removal may nevertheless require a subsequent drill-out or milling intervention.

Drill-out and/or milling removal of isolation valves and other, usually metal-based obstructions, is generally driven by way of a coiled tubing or drill pipe operations. So for example, production operations may be shut down as large scale coiled tubing equipment is delivered at the oilfield and rigged up to the well. A milling tool may then be advanced downhole by way of coiled tubing with a rotatable bit of the tool directed at the isolation valve to achieve its removal. In the case of coiled tubing, 25-50 horsepower or more may be reasonably available for driving such milling. Further, where more power is desired, substantially larger scale drill pipe equipment may be utilized to drive the milling application, such equipment readily supplying horsepower in the hundreds.

Unfortunately, driving of such milling and/or drill-out applications comes at a fairly significant price. Namely, the time required to rig-up and run such large scale applications may be quite costly, not to mention the amount of footspace required to support such equipment. Indeed, in addition to recognizing the significant expenses involved in completions operations as described above, significant efforts have also been directed at cost-reductions for follow-on maintenance applications such as the noted milling and drill-out applications. Thus, recently efforts have been made to allow for delivery and powering of such applications over wireline conveyance.

Wireline delivery of milling and/or drill-out tools involves the rig-up and deployment of much smaller scale wireline equipment, as compared to the above noted coiled tubing or drill pipe deployment equipment. Thus, the time and footspace required for rig-up and running of the application may be dramatically reduced, not to mention the overall manpower required.

Unfortunately, wireline equipment effectively provides a limited amount of horsepower downhole, generally well below 10 horsepower. In circumstances where the equipment is employed to aid in scale removal, such power may be more than adequate. However, as described below, where the application is directed at the removal of isolation valves and other such metal based features, particular challenges may arise that prevent efficient or effective removal with such limited horsepower available.

The rotating bit of a drill-out or milling tool is forcibly driven in a downhole direction by way of an adjacent actuator that includes a reciprocating piston. This piston is itself hydraulically driven. In other words, fluid pumped in and out of a pressurizable housing may be used to reciprocate the piston. However, such fluid is inherently compressible to a certain degree. That is to say, pressure in a chamber of the housing may be driven up to advance the piston. However, such pressure may alternately result in a degree of compression of the fluid itself. To the extent that this occurs, the piston is no longer forcibly driven. Ultimately, this may result in a 'bounce' or a certain degree of inconsistency in the driving of the bit relative the obstruction.

Where the obstruction is a metal-based feature, such inconsistent driving or 'bouncing' of the milling or drill-out bit may result in cold working and hardening of the feature. This is due to the fact that with less than about 5-10 horsepower available, even a minor degree of bounce is likely to translate into actual intermittent disengagement of the bit relative the feature. As a result, the amount of time required to complete the removal of the feature may be increased dramatically. Such is often the case where the feature is an isolation valve which is often of a metal based superalloy. Furthermore, where a carbide or other sufficiently hard bit is employed, the likelihood of the bit breaking in response to such bouncing and hardening of the valve is quite significant. Indeed, where this occurs, the entire wireline assembly may be removed from the well for bit replacement, thereby adding as much as a day's worth of time to the application. Therefore, at present, wireline deployment of milling and/or drill-out equipment is generally foregone in place of much more expensive and time consuming alternatives.

SUMMARY

A downhole tool assembly is provided that includes a rotatable tool for deployment in a well over wireline conveyance. The tool is hydraulically driven through an actuator coupled thereto. Further, the actuator includes a reciprocating ball screw piston for interfacing a mounted ball nut so as to enhance the consistency of its driving of the tool.

The reciprocating ball screw piston may include a head disposed in a pressure housing. Thus, guided reciprocation of the piston may be achieved. A ball screw of the piston may also be present which is coupled to the head and also disposed outside of the housing where it is configured to interface the mounted ball nut. The interfacing of the nut may be a threadable interfacing such that damping is allowed thereby enhancing the consistency of the driving of the tool.

An embodiment of a compound linear actuator comprises an actuator comprising at least an axially movable component configured to be displaced in opposing directions by the actuator and an axial displacement conversion device coupled to the axially moveable component for enhancing consistency of the movement of the component.

DETAILED DESCRIPTION

Embodiments are described with reference to certain downhole applications where a rotatable cutting device is employed. In particular, wireline deployed tools are shown and described which are directed at milling out certain downhole obstructions. However, a variety of low horsepower driven rotatable downhole tools may take advantage of enhanced hydraulic tools and techniques detailed herein. For example, drilling tools and other devices may utilize actuators detailed herein to help avoid irregular downward or axial thrust during drill out applications, during actuation of sliding sleeves, during actuation of valves with shifting profiles, etc.

Figure 1:
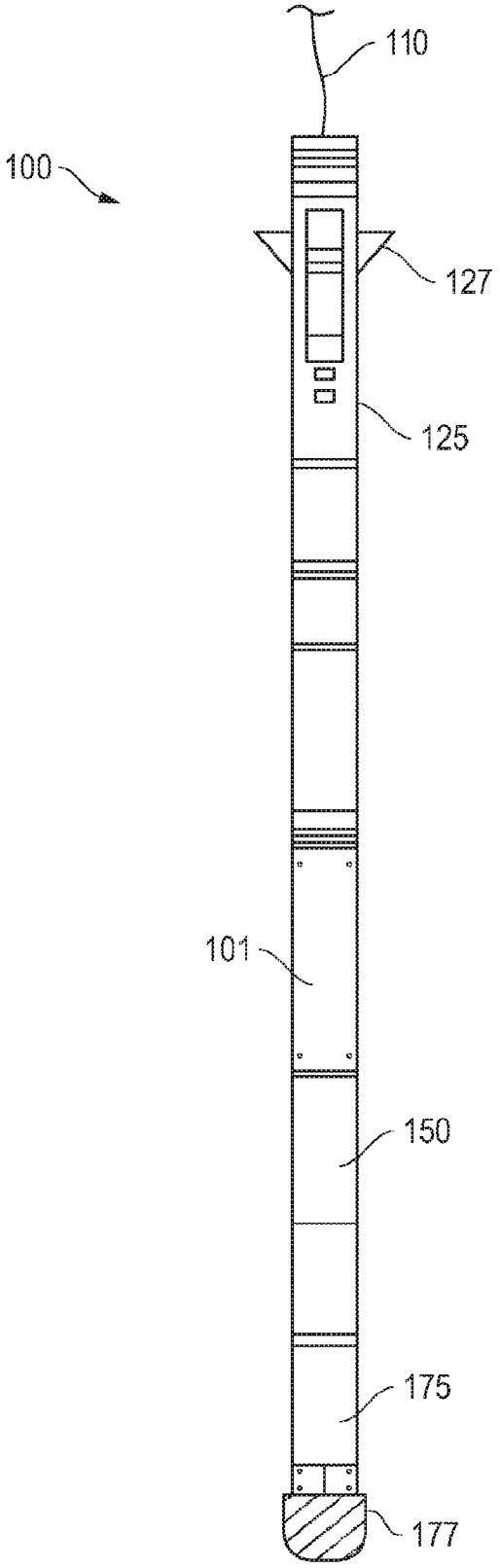
FIG. 1 is a side vertical view of an embodiment of a rotatable wireline tool employing an actuator for enhanced drive consistency.

Referring now to FIG. 1, an embodiment of a rotatable wireline tool in the form of a milling tool 100 is shown. The tool 100 is configured for deployment in a well by way of wireline 110. Indeed, wireline 110 is depicted running from an anchoring device 125 of the tool 100 at the uphole end thereof. In alternate embodiments, a tractor or other suitable device may be utilized for anchoring. Regardless, as detailed herein below, the deployment via wireline 110 provides several cost and time saving advantages over a more conventional drill pipe or coiled tubing deployment for rotating cutting tools.

Figure 4:
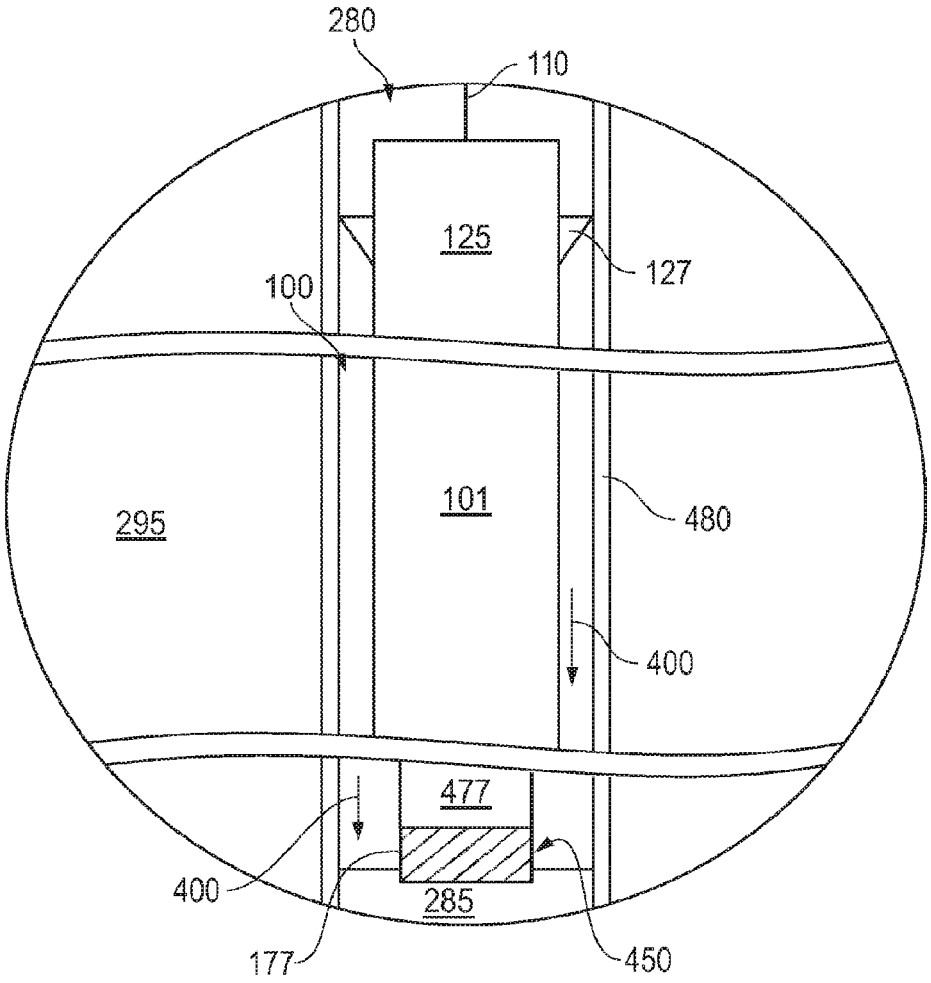
FIG. 4 is a side view of the wireline tool and actuator of FIGS. 1-3C revealing enhanced drive consistency as the tool is employed in a milling application.

The milling tool 100 is equipped with an actuator 101 which provides an axial force for driving a bit 177 of a rotary cutting device 175 into an obstruction to achieve its deterioration and removal (see FIG. 4). Indeed, for the embodiments detailed herein, the actuator 101 provides enhanced consistency in the amount of axial velocity and resulting axial force or drive provided to the rotating cutting device 175 and bit 177 during a milling application. That is, as detailed further below, the tool 100 may be positioned at a downhole location adjacent an obstruction. Anchor arms 127 of an anchor housing 125 may then be deployed to immobilize the tool 100. The cutting device 175 and bit 177 may be rotated by a rotation drive 150. Then, the device 175 and bit 177 may be driven downward through the obstruction to achieve its removal. The actuator 101 of embodiments detailed herein allow for such driving of the device 175 and bit 177 to take place in a reliably consistent manner even with less than about 10 horsepower available as would be typical for such a wireline powered application.

Figure 3A:
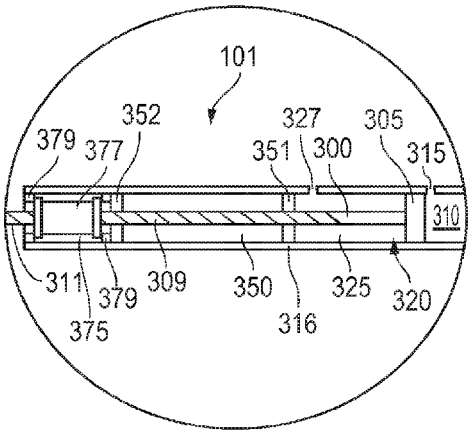
FIG. 3A is an enlarged cross-sectional view of the actuator of FIG. 1 revealing dampening features for the enhanced drive consistency.
Figure 3B:
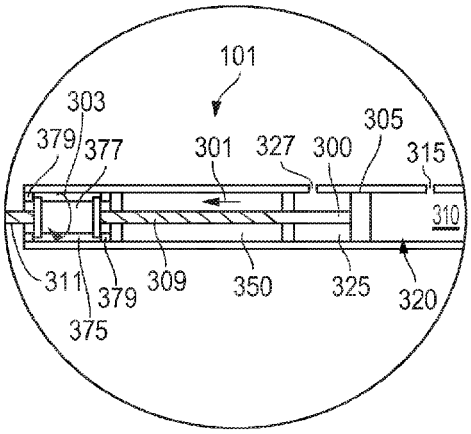
FIG. 3B is an enlarged cross-sectional view of the actuator of FIG. 3A revealing movement of piston and ball nut features in given directions.
Figure 3C:
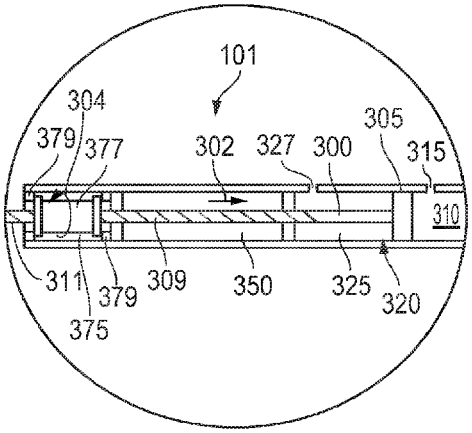
FIG. 3C is an enlarged cross-sectional view of the actuator of FIG. 3B revealing movement of the noted features in directions opposite the given directions.

The actuator 101 may be hydraulic in nature as detailed in FIGS. 3A-3C. Thus, compression of hydraulic fluid during the course of the milling application remains a possibility. However, unlike a conventional milling tool, the tool 100 of FIG. 1, is equipped with features that dampen and minimize the effect of such compression on the downward drive imparted on the device 175 and bit 177 during a milling application. That is to say, 'bouncing' of the downward drive is minimized or substantially eliminated and an enhanced drive consistency attained. As a result, low power, wireline driven deployment of the milling tool 100 for a milling application is rendered a practical and viable solution for removal of even metal based downhole obstructions.

Figure 2B:
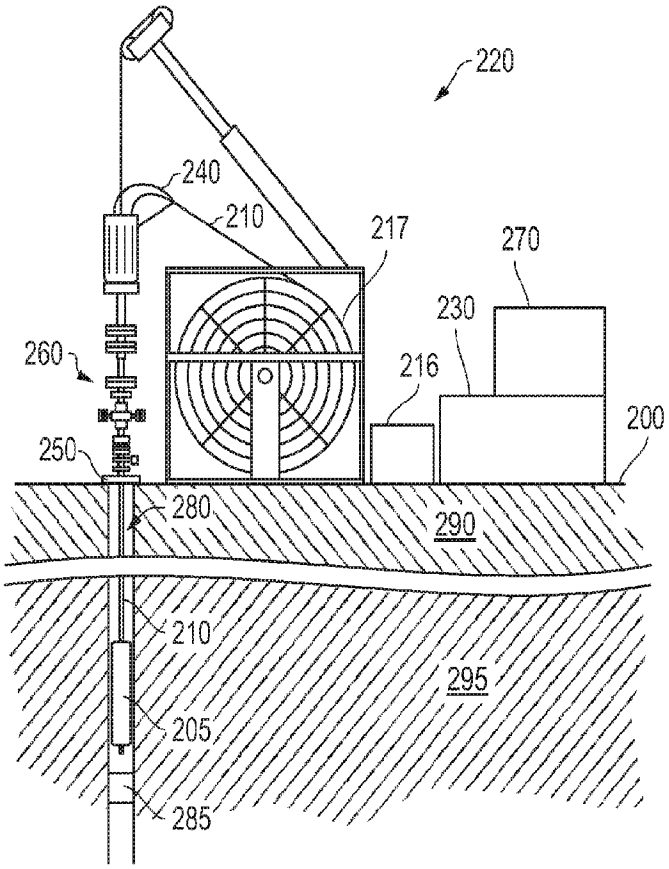
FIG. 2B (Prior Art)
FIG. 2B is a schematic prior art overview of the oilfield of FIG. 2A wherein a coiled tubing tool is disposed in the well in lieu of the wireline tool.
Figure 2A:
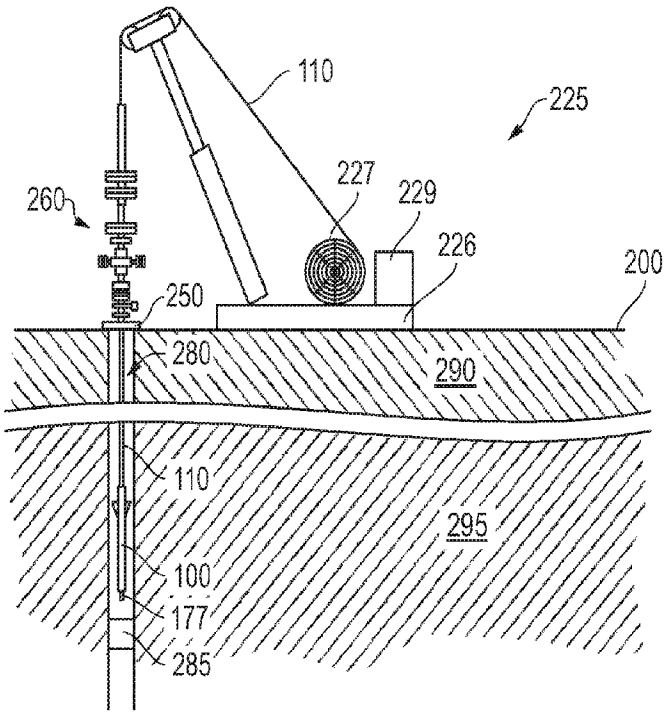
FIG. 2A is a schematic overview depiction of an oilfield accommodating a well wherein the wireline tool of FIG. 1 is disposed.

Referring now to FIGS. 2A and 2B, wireline deployed milling operations supported by embodiments of the milling tool 100 detailed herein are contrasted with operations that involve larger scale equipment to support operations. Namely, a substantial reduction in the amount of overall equipment and footspace required to support operations depicted in FIG. 2A is apparent as compared to the conventional milling operations depicted in FIG. 2B. As a result, corresponding time, equipment and overall cost savings may be realized in the wireline deployment of FIG. 2A as detailed below.

FIG. 2A provides an overview of an oilfield 200 accommodating a well 280 traversing various formation layers 290, 295. The milling tool 100 of FIG. 1 is disposed in the well 280 for operations therein. In the embodiment of FIG. 2A, lightweight wireline deployment equipment 225 may be utilized for delivery of the tool 100. Namely, a smaller footprint wireline skid 226 occupying a smaller amount of footspace than the coiled tubing equipment 220 of FIG. 2B may be utilized to provide a wireline spool 227 to the oilfield 200. Wireline 110 may be strung from the skid 226, through a well head 250 at the surface of the oilfield 200 and into the well 280. The delivery along with other aspects of the application may be directed through a control unit 229 also provided at the skid 226. Regardless, such a low power winch driven delivery may suffice for lowering the tool 100 to a target location adjacent an obstruction 285 as shown.

As described above, the obstruction 285 may be a conventional metal component such as an isolation valve, perhaps of superalloy construction. Further, the bit 177 of the tool 100 may be a carbide or comparably hard material. Nevertheless, and in spite of having available power of less than about 10 horsepower available, the tool 100 may achieve complete drill out of the obstruction 285 in about two hours. As indicated above and detailed below, such wireline milling is rendered practical due to the inclusion of an actuator 101 of enhanced drive consistency that substantially avoids any 'bounce' in drive during the application. The substantial elimination of this bounce also advantageously allows for a reduction in power requirements for the cutting device 175 as compared to the power requirements of the coiled tubing equipment 220 of FIG. 2B, discussed in more detail below.

By way of comparison, conventional milling operations are depicted in FIG. 2B which also avoid 'bounce' in drive during removal of an obstruction 285. However, the prior art overview of the oilfield 200 of FIG. 2B reveals the use of substantially higher horsepower coiled tubing equipment 220 as a means by which to avoid the noted 'bounce'. This equipment 220 includes a larger scale coiled tubing 210 for delivery and powering of a larger milling tool 205. The coiled tubing 210 is drawn from a heavier and less mobile coiled tubing reel 217 which is shown located adjacent a control unit 216 at the oilfield 200. Similar to the wireline skid 226 of FIG. 2A, the equipment 220 may also be mounted on at least one skid (not shown) comprising a tank 230, such as a liquid containment tank or the like, and associated large scale pump unit 270, which is provided so as to maintain substantial pressure in the coiled tubing 210 during the milling application.

Continuing with reference to FIG. 2B, the coiled tubing 210 is strung through a rig supported goose neck injector assembly 240. The assembly 240 is utilized in driving the coiled tubing 210 through pressure regulating equipment such as the depicted blowout preventor 260. Thus, the coiled tubing 210 and milling tool 205 may again be directed to a target location adjacent a metal based obstruction 285 to achieve its removal. Indeed, this may be achieved under high axial drive horsepower conditions, perhaps exceeding 25 to 50 horsepower or more. Therefore, no significant concern over 'bounce' as described above is present. Unfortunately, however, removal of such concern comes at a cost of having to deliver and deploy much more massive and expensive equipment 220. Even the rig up time required for utilization of such equipment 220 comes at a substantially greater cost as compared to the embodiment depicted in FIG. 2A which allows for the simpler deployment of a wireline tool 100.

Referring now to FIGS. 3A-3C enlarged cross-sectional views of the actuator 101 are shown. With added reference to FIG. 2A, embodiments of this actuator 101 are responsible for the enhanced drive consistency that allow for the tool 100 to be configured for wireline deployment. Thus, as described above, the need for large scale, more expensive drill pipe or coiled tubing deployment, as depicted in FIG. 2B, may be avoided.

The cross-sectional view of FIG. 3A reveals dampening features of the actuator 101 for the enhanced drive consistency. More specifically, a housing 316 is provided which accommodates various chambers 320, 350, 375. A pressure chamber 320 in particular is provided in which a head 305 of a piston or piston rod 300 is disposed. The piston head 305 sealingly and dynamically isolates uphole 310 and downhole 325 sides of the chamber 320 from one another. Thus, as detailed further below, an influx of hydraulic fluid pressure through an uphole port 315 may correspond with an outflow of hydraulic fluid pressure through a downhole port 327 as the piston 300 is driven to the left as depicted. Of course, with the piston 300 moved to the left it may be subsequently driven to the right by initiating an influx of pressure through the downhole port 327. In this manner, a reciprocating piston 300 may be utilized to provide the axial driving force for the wireline milling tool of FIGS. 1 and 2A.

Continuing with reference to FIG. 3A, the piston 300 exits the pressure chamber 320 traversing an intermediate chamber 350 where its rod transitions into a ball screw 309. The ball screw 309 is configured for threadably engaging a ball nut 377 disposed in the next adjacent chamber 375, referred to herein as the dampening chamber 375, detailed further below. As used herein, the terms "ball nut" and/or "ball screw", and/or "axial displacement conversion device" are meant to refer to any component that converts or transforms an axial displacement into a rotational or angular displacement including a lead screw, a planetary roller screw, an acme screw or the like, and may not be limited to a conventional ball nut and screw assembly. Further, the dampening chamber 375 also accommodates thrust bearings 379 to support stable rotation of the ball nut 377 as it interfaces with the ball screw 309 of the reciprocating piston.

At one side of the dampening chamber 375, the noted intermediate chamber 350 is disposed. The intermediate chamber 350 provides a separation between the pressure chamber 325 and the dampening chamber 375 and may be defined by a seal member 351 adjacent the pressure chamber 325 and a seal member 352 adjacent the dampening chamber 375. However, in an alternate embodiment, these chambers 325, 375 may be located immediately adjacent one another without the intervening intermediate chamber 350. Further, at the other side of the dampening chamber 375, an extension 311 of the ball screw 309 is shown exiting the chamber 375. It is this extension 311 which interfaces downhole portions of the milling tool 100 to maintain downward axial drive 400 for a milling application (see FIG. 4).

Referring now to FIG. 3B, the dampening characteristics of the dampening chamber 375 are described. That is, as described above, the piston 300 shown in FIG. 3B is moved in the leftward direction 301 by the influx of hydraulic fluid pressure through the uphole port 315. As alluded to earlier, however, the nature of hydraulic fluid is such that it may be compressible. Therefore, in theory, the degree to which the piston 300 is moved in this direction 301, or even in an opposite direction 302 (see FIG. 3C) based on the influx through the uphole port 315 may be somewhat irregular. This is what results in the potential for a 'bounce' as described above. However, as described below, the dampening chamber 375, and the ball nut 377, more specifically, serve to minimize and/or substantially eliminate such irregularity in the directional movement of the piston 300.

As indicated above, the ball screw 309 threadably engages or interfaces the ball nut 377. Thus, as shown in FIG. 3B, the movement of the piston 300 in the leftward direction 301 results in a rotation 303 of the ball nut 377. This rotation 303 is guided by the advancing piston 303 and modulated to a degree by the thrust bearings 379. That is, while the thrust bearings 379 may be configured to allow for low friction rotation of the nut 377, they may also serve to discourage completely free or opposite rotation (e.g. see 304 of FIG. 3C). Thus, smaller, irregular directional movements of the ball screw 309 may be substantially eliminated, thereby removing the potential for 'bounce'. Rather, larger pressure driven directional movement, such as an influx of pressure in the downhole port 327 is essential to overcome the initial inertia and achieve movement of the piston 300 in the opposite direction 302 (again, see FIG. 3C). As a result, in spite of lower Horsepower available, a more consistent downward axial drive force may be maintained as the milling tool 100 is employed in an application such as that shown in FIG. 4.

Referring now to FIG. 3C, the actuator 101 is shown with the piston 300 moved in the rightward direction 302. As described above, the dampening chamber 375 and features thereof ensure that movement in this direction 302 is a result of a sufficient influx of hydraulic pressure fluid into the pressure chamber 320 and not merely a result of the compressibility of such fluid. As shown in FIG. 3C, sufficient force is supplied for driving the piston head 305 in the rightward direction 302, thereby overcoming the initial rotation 303 of the ball nut 377 as shown in FIG. 3B. Thus, the ball nut 377 is now rotated in an opposite direction 304, and again modulated by the thrust bearings 379 to minimize or substantially eliminate the effects of smaller 'bouncing' forces resulting from the use of a compressible fluid in driving the actuator 101.

In addition to the thrust bearings 379, the mass and diameter of the ball nut 377, the radius of its rotations, the pitch of the ball screw 309, and other architectural features of the interfacing components may be configured to affect the degree of modulation provided by the depicted configuration. Fluid drag may also be a factor. Further, the piston head 305 and corresponding housing shape may be non-circular to discourage its rotation. Similarly, a key or other alternate device may be utilized to discourage rotation of the piston 300. By the same token, in an alternate embodiment, the ball nut 377 may be mounted in a non-rotatable manner, with modulated rotation of the piston 300 utilized to minimize or substantially eliminate 'bounce' as detailed herein.

Referring now to FIG. 4, a side view of the wireline milling tool 100 is shown as it is employed in the well 280 during a milling application. The above-detailed actuator 101 provides enhanced drive consistency as the tool 100 is axially driven in a downward direction 400 for cutting through the obstruction 285. This enhanced consistency which substantially eliminates bounce as described above, is achieved even though the tool 100 is deployed and powered via conventional wireline 110.

In the embodiment shown, anchor arms 127 of an anchor housing 125 are driven into immobilizing engagement with a casing 480 or any other tubing defining the well 280. Thus, the actuator 101 is able to effectively drive the rotating bit 177 into the obstruction. Further, in the embodiment shown, a reamer or cutter 477 is provided adjacent the bit 177 to further aid in milling out and through the obstruction 285. As noted in detail above, such milling out and cutting through the obstruction 285 in this manner is achieved with enhanced drive consistency.

Figure 5:
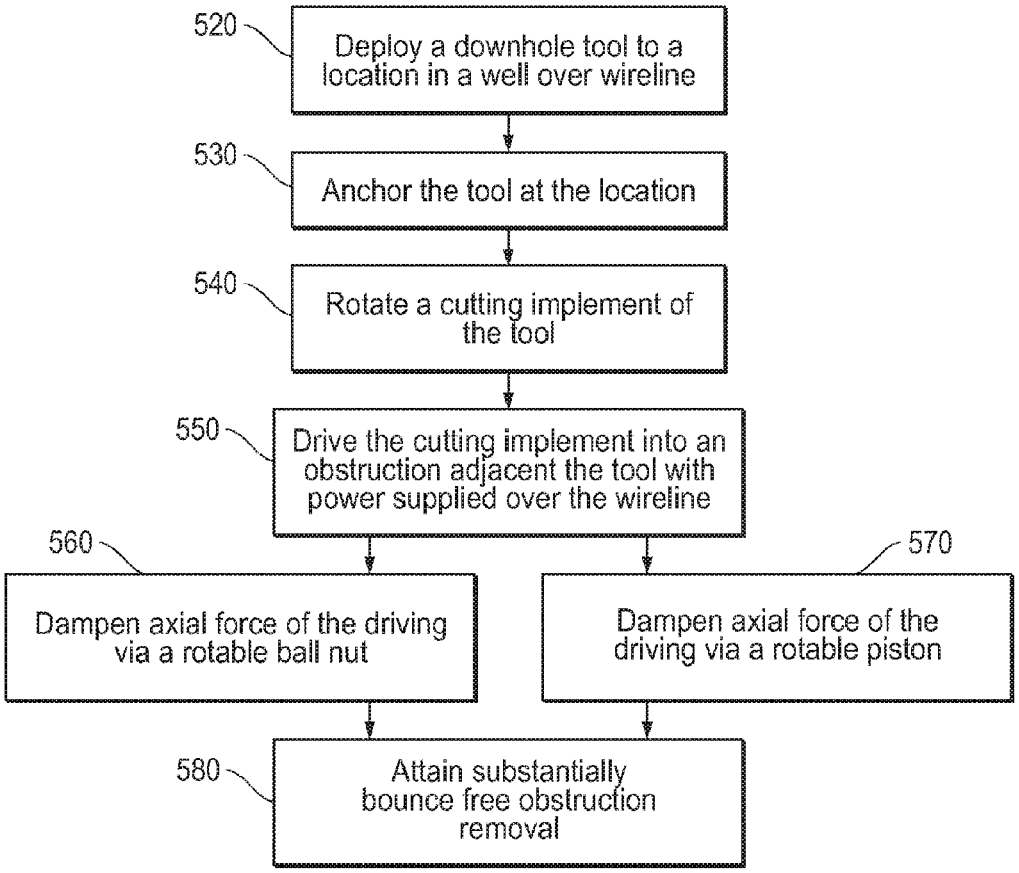
FIG. 5 is a flow-chart summarizing an embodiment of employing a rotatable wireline tool of enhanced hydraulic drive consistency.

Referring now to FIG. 5, a flow-chart is provided summarizing an embodiment of employing a rotatable wireline tool of enhanced hydraulic drive consistency. As noted above and indicated at 520, an advantage to embodiments detailed herein is the ability to utilize wireline deployment. Once the tool is positioned at the targeted location it may be anchored and rotation initiated as indicated at 530 and 540, respectively.

The rotating cutting implement, such as the above described bit, may then be driven into an obstruction with no more than the limited horsepower available over the wireline (see 550). Furthermore, by taking advantage of characteristics of an actuator of the tool, this downward force may be dampened as indicated at 560 and 570. Thus, as shown at 580, substantially bounce free obstruction removal may be achieved in a couple of hours. Indeed, this may even be the case where the obstruction is of a metal-based superalloy and in spite of having no more than about 5 horsepower available for the drilling, cutting, milling, etc.

Embodiments of rotatable downhole tools as described herein are configured to achieve substantially bounce free obstruction removal in spite of being deployed over wireline conveyance. That is, even though the power available for driving a cutting implement of the tool is generally no more than about 5 horsepower, the enhanced drive consistency allows for a practical and effective milling, drill-out, etc. Undue concern over cold working or other potential challenges where the obstruction is metal-based are also substantially eliminated. As a result, higher cost deployment alternatives, such as coiled tubing and drill pipe deployment may be avoided.

The preceding description has been presented with reference to presently preferred embodiments. Persons skilled in the art and technology to which these embodiments pertain will appreciate that alterations and changes in the described structures and methods of operation may be practiced without meaningfully departing from the principle, and scope of these embodiments. Regardless, the foregoing description should not be read as pertaining only to the precise structures described and shown in the accompanying drawings, but rather should be read as consistent with and as support for the following claims, which are to have their fullest and fairest scope.

The invention claimed is:

1. A downhole tool for deployment in a well, the tool comprising:

a rotatable cutting device; and an actuator coupled to said device for driving the rotatable cutting device into an obstruction, said actuator having a piston to interface the rotatable cutting device for the driving and an axial displacement conversion device for consistency of the driving wherein the axial displacement conversion device comprises a threadable interface of a ball screw and a ball nut, and wherein the actuator comprises a housing defining: a dampening chamber accommodating the ball nut; and a pressure chamber isolated from said dampening chamber and accommodating a head of the piston for dynamically defining uphole and downhole chamber sides to allow hydraulic reciprocation of the piston.

2. The tool of claim 1 wherein said cutting device comprises a bit for a milling application.

3. The tool of claim 1 wherein the deployment is wireline deployment.

4. The tool of claim 1 further comprising an anchoring device coupled to said actuator for immobilizing a portion of the tool to support the driving.

5. The tool of claim 1 further comprising an intermediate chamber disposed between said dampening and pressure chambers and accommodating a portion of the ball screw.

6. An oilfield assembly comprising:

deployment equipment disposed at an oilfield surface;

and a downhole tool coupled to said deployment equipment and disposed in a well below the surface, said downhole tool having an actuator for imparting an axial drive toward an obstruction in the well, the actuator having an axial displacement conversion device for consistency of the drive, wherein the axial displacement conversion device comprises a threadable interface of a ball screw and a ball nut, and wherein the actuator comprises a housing defining: a dampening chamber accommodating the ball nut and a pressure chamber isolated from said dampening chamber and accommodating a head of a piston for dynamically defining uphole and downhole chamber sides to allow hydraulic reciprocation of the piston.

7. The assembly of claim 6 wherein said obstruction is of metal based construction.

8. The assembly of claim 7 wherein said obstruction is a superalloy.

9. The assembly of claim 6 wherein said downhole tool is coupled to said equipment via a wireline cable.

10. A method comprising:

deploying a downhole tool to a location in a well;

rotating a cutting implement of the downhole tool;

driving the cutting implement into an obstruction adjacent the location; and dampening a force of said driving via a reciprocating threadable interfacing of an axial displacement conversion device disposed in an actuator coupled to the cutting implement, wherein the axial displacement conversion device comprises a threadable interface of a ball screw and a ball nut, and wherein the actuator comprises a housing defining: a dampening chamber accommodating the ball nut and a pressure chamber isolated from said dampening chamber and accommodating a head of a piston for dynamically defining uphole and downhole chamber sides to allow hydraulic reciprocation of the piston.

11. The method of claim 10 wherein said deploying comprises a wireline deployment of the tool.

12. The method of claim 10 further comprising anchoring a portion of the downhole tool prior to said driving.

13. The method of claim 10 further comprising removing the obstruction in a bounce free manner.

* * * * *